United States Patent [19]

Peters

[11] 4,383,459

[45] May 17, 1983

[54] MEAT CUTTER FOR SLICING SOFT-MEAT LOGS

[75] Inventor: James H. Peters, Cologne, Minn.

[73] Assignee: Waconia Manufacturing Industries, Inc., Waconia, Minn.

[21] Appl. No.: 275,692

[22] Filed: Jun. 22, 1981

[51] Int. Cl.[3] ..... B26D 3/26; B26D 7/06

[52] U.S. Cl. ..... 83/411 R; 83/425.3; 83/431

[58] Field of Search ..... 83/411 R, 426, 431, 83/602, 425.3

[56] References Cited

U.S. PATENT DOCUMENTS

| | | | |
|---|---|---|---|
| 3,212,185 | 10/1965 | Keiter | 83/411 R X |
| 3,538,802 | 11/1970 | Helm et al. | 83/411 R |
| 3,685,372 | 8/1972 | Ehm et al. | 83/411 R |
| 3,759,128 | 9/1973 | Dewhurst | 83/411 R |
| 3,797,353 | 3/1974 | Calhan | 83/431 X |
| 4,144,784 | 3/1979 | Jones | 83/425.3 |
| 4,329,895 | 5/1982 | Perini | 83/431 X |

*Primary Examiner*—Donald R. Schran

*Attorney, Agent, or Firm*—Williamson, Bains, Moore & Hansen

[57] ABSTRACT

The meat cutter of the instant invention is designed for slicing into a number of chunks soft-meat logs such as braunschweiger and the like. The log is held in a slotted trough which revolves about a first axis. A gang of knives pivotable about a second axis parallel to the first axis is arranged to correspond to the slots in the trough. Upon actuation, the trough and knives rotate towards each other, thereby imparting a slicing motion to provide a clean cut.

7 Claims, 4 Drawing Figures

MEAT CUTTER FOR SLICING SOFT-MEAT LOGS

BACKGROUND OF THE INVENTION

Over the years the meat industry has utilized a number of types of slicing and cutting devices. None of these devices, however, have proved to be effective when working with soft-meat logs such as braunschweiger and the like. Known devices include straight chopping-type devices and rotating-blade slicers. The chopping-type slicers tend to squeeze and provide an unsatisfactory cut while the rotating-blade slicer tends to acquire meat buildup on the blade after operation for which reason it is also unsatisfactory. Thus, until now, even the most highly automated factories which wish to slice soft meats have utilized hand labor in order to do so. The hand-slicing motion has proved to be the most effective cutting method.

It is, therefore, an object of this invention to essentially automate this slicing process for the softer meats, and toward this end it is an object of this invention to provide a motion similar to the hand-slicing motion heretofore used.

SUMMARY OF THE INVENTION

A trough having an L-shaped cross section is mounted so as to be able to be revolved about a first axis of revolution, the first axis being coincident with a shaft rotatably mounted on the frame. The trough is roughly L-shaped in cross section and has slots therein perpendicular to the direction of elongation so as to be able to allow the knives to cut the complete log of meat. A plurality of knife blades are located in the knife rack which is pivotably mounted on the frame and is able to be rotated toward the trough. A first actuating arm is attached to the trough shaft and extends toward the blade rack. A cam follower is located on the outward end of the actuating arm and rides in a slot located in the blade rack such that when the shaft is rotated, the trough and knives rotate toward each other thereby imparting a slicing motion simulating the hand-cutting operation. A pneumatic cylinder actuates a second actuating arm attached to the shaft thereby initiating the motion. A plate is swung over the trough to act as a guard and hold the meat log in place during the cutting process.

These and other objects and advantages of the invention will become readily apparent as the following description is read in conjunction with the accompanying drawings wherein like reference numerals are used to refer to the several views.

DESCRIPTION OF THE PREFERRED EMBODIMENT

Figure 1:
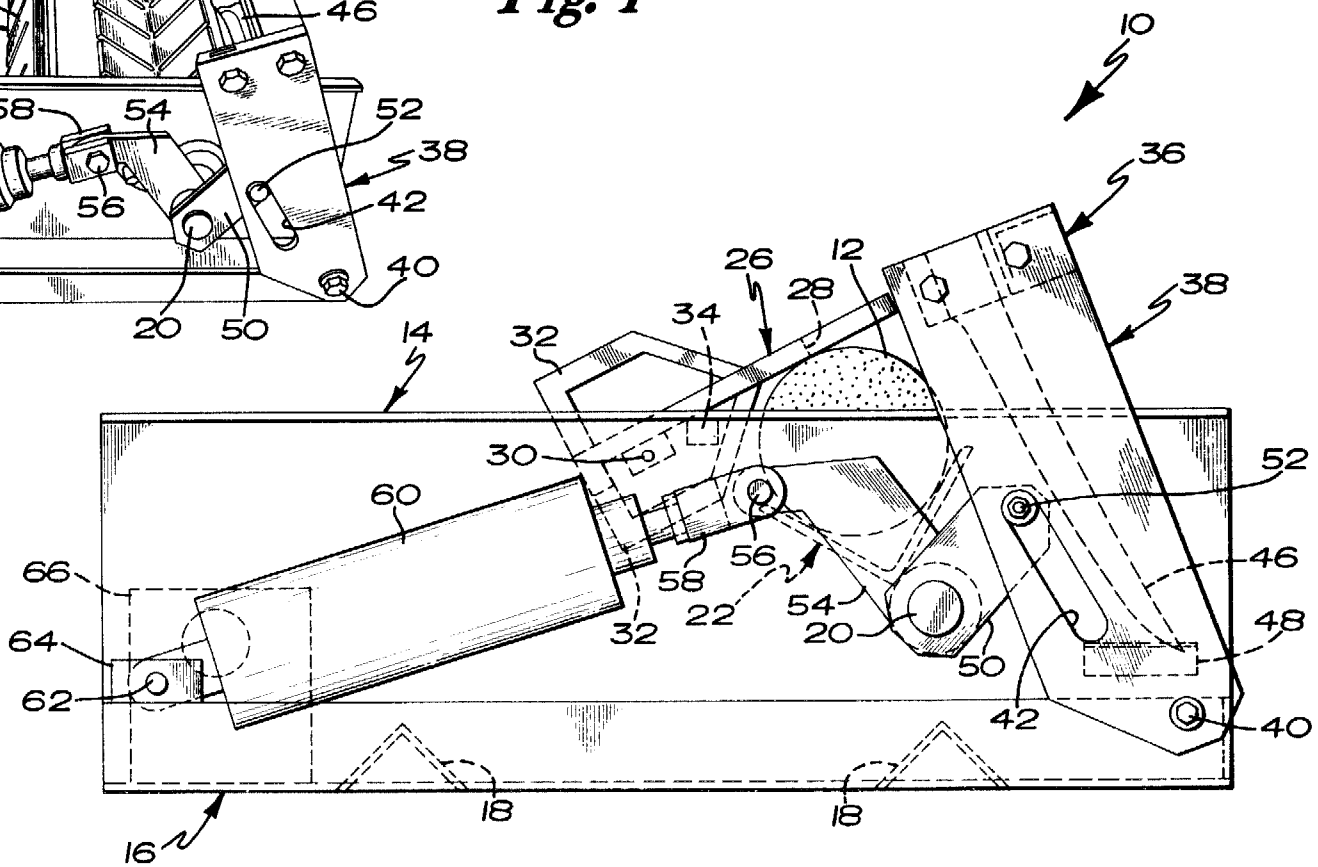
FIG. 1 is a perspective view of the device.
Figure 2:
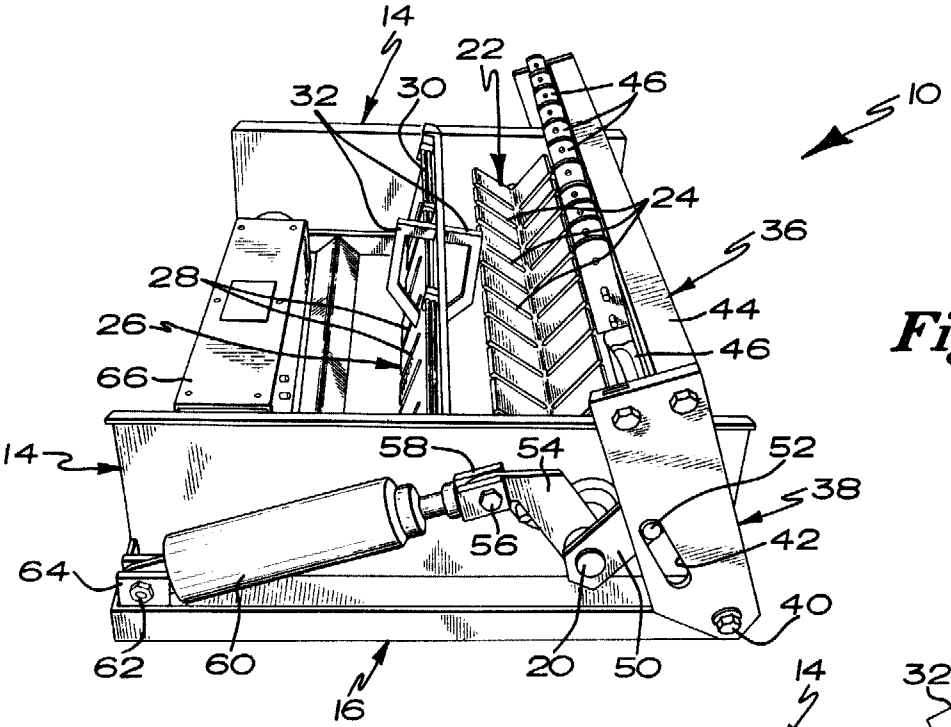
FIG. 2 is a side plan view of the device ready for cutting.

The invention, generally 10, is designed for cutting a soft-meat log 12 into a number of chunks as desired. Meat log 12 is typically braunschweiger or similar soft log. Slicer 10 is comprised of a frame 14 which is made up of side rails 16 and which are J-shaped in cross section joined together by right-angled cross rails 18. A shaft 20 is rotatably mounted in side rails 16 and forms a first axis of revolution about which trough 22 is mounted and revolves. As can be seen in FIGS. 1 and 2, trough 22 is roughly right angled in cross section and has a number of slots 24 which extend nearly to the bottom thereof for allowing a complete cut, which will be described and shown more fully hereinafter. The placement of slots 24 is arranged to coincide with the location of the knives.

A hold-down member 26 is rotatably mounted on shaft 30 between side rails 16 as shown in FIGS. 1 and 2. Desirably, hold-down 26 is formed of clear plexiglass or similar material to allow viewing therethrough during the operation. Hold-down 26 is provided with slots 28 located to correspond to the placement of trough slots 24 to allow passage of the knife blades. Handles 32 are provided on either side of hold-down 26 to allow hold-down 26 to be rotated into position prior to use. FIG. 1 shows the hold-down swung out of the way while FIG. 2 shows the hold-down in position prior to the beginning of the cut. A microswitch 34 may be mounted on side rail 16 so that slicer 10 may not be operated unless hold-down 26 has been swung into the position shown in FIG. 2.

Knife assembly 36 is also rotatably mounted to side rail 16 by means of bolts 40. Knife assembly 36 revolves about second axis of revolution coincident with bolts 40. Knife assembly 36 is comprised of end plates 38 which have a cam slot 42 therein. Crossbar 44 is mounted between end plates 38 and knife blades 46 are mounted by means of bolts or the like to crossbar 44. The spacing of knife blades of course is a matter of choice, depending upon the size of chunks which are desired to be cut. A guard plate 48 is mounted between side rail 16 adjacent the bottom edge of knife blades 46 and serves to guard and cover the end of knife blades 46. Guard 48 is essentially a plate with slots therein.

A first actuating arm 50 is mounted to shaft 20 and has located at its outward end a rotatable cam follower 52. Cam follower 52 is located in clamp 10 slot 42 in end plate 38 of knife assembly 36. Also mounted to shaft 20 is second actuating arm 54. A bolt 56 attaches a clevis 58 to the other end of second actuating arm 54. Clevis 58 is in turn mounted to one end of hydraulic cylinder 60, which is fixed at its other end to mounting flanges 64 by means of bolt 62. It is understood here that in using the term hydraulic cylinder 60, this would allow use of any fluid operated cylinder; i.e., liquid or pneumatic. In the preferred version, a pneumatic cylinder is utilized. A controller 66 is provided for operation of the device. Controller 66 and the plumbing for cylinder 60 is well known and hence is not described herein in detail. Desirably, however, controller 66 is of the variety that requires two hands to operate so that the operator must withdraw his hands from the vicinity of the knives in order to operate the mechanism.

The preferred material for construction of the instant invention is stainless steel except as otherwise herein noted, stainless steel being the preferred material of construction for most food processing machinery. Of course, if desired, other suitable materials may be used.

Figure 3:
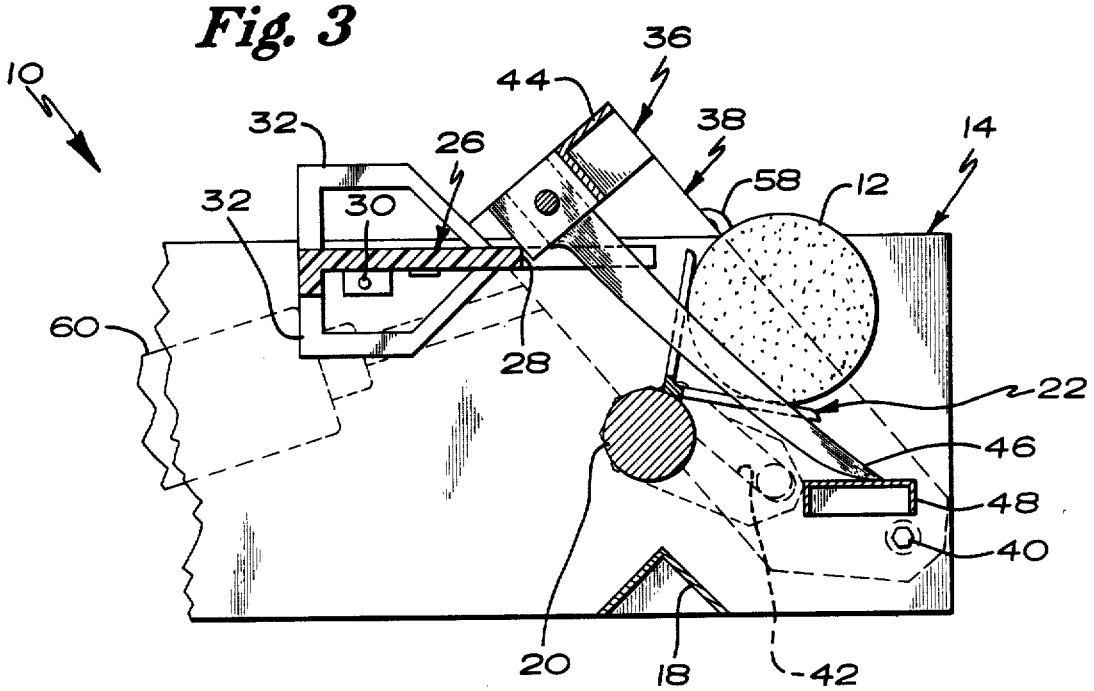
FIG. 3 is a partial side plan view at the completion of the cutting operation.
Figure 4:
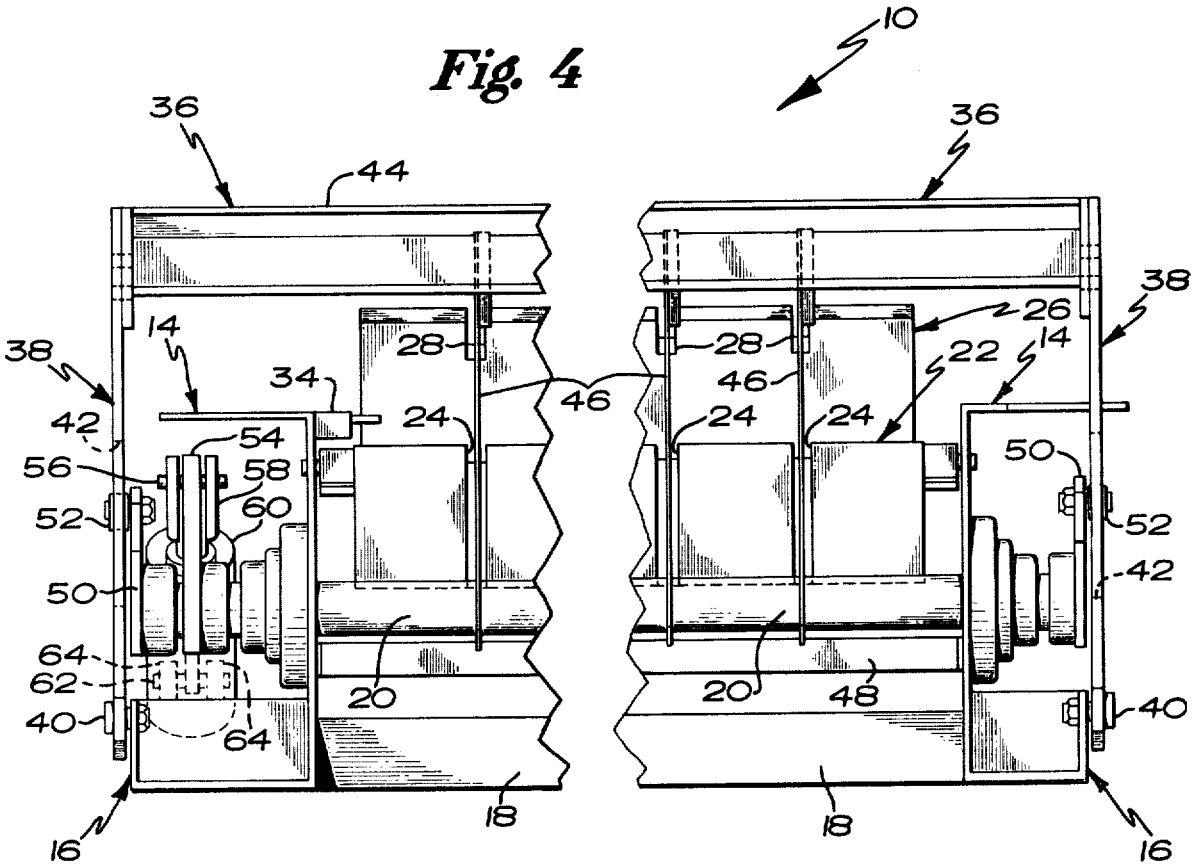
FIG. 4 is a front plan view of the device.

In operation, device 10 operates simply and efficiently. The operator places a meat log 12 into trough 22 and then grabs handle 32 of hold-down 26 and swings it into the position shown in FIG. 2. Thence, the operator operates control 26 with two hands thereby activating cylinder 60. This actuation causes second actuating arm 54 to rotate in a clockwise direction about shaft 20 thereby causing trough 22 to revolve about shaft 20 at the same time. Also, first actuating arm 50 is rotated in a clockwise direction moving cam follower 52 downwardly in cam slot 42 of blade assembly 36 and causing blade assembly 36 to rotate about the second axis of revolution coincident with bolts 40 in a counter clockwise direction. It is to be noted that as trough 22 revolves about shaft 20, a slicing motion is imparted whereby the meat log 12 has a component of motion parallel to the length of knife blades 46 thereby producing a simulation of the hand-slicing motion. It is to be noted that the mechanism ends in the position shown in FIG. 3 and as that position is reached, the sliced chunks roll off trough 22 onto a receiving surface (not shown) so that the operator need not remove the chunks from the machine.

This contemplates that various changes and modifications may be made to this device without departing from the spirit and scope of the invention as defined by the following claims.

What is claimed is:

1. A meat cutter for slicing soft-meat logs, said cutter comprising:

trough means for holding a meat log, said trough means having an axis of elongation, said trough means revolving through a first arc about a first axis of revolution, said first axis of revolution being parallel to said axis of rotation of said trough means;

at least one knife blade having a cutting edge;

blade holding means revolving about a second axis of revolution, said second axis of revolution being parallel to said first axis of revolution, each said knife blade being mounted in said blade holding means normal to said second axis of revolution with each said cutting edge facing said trough means; and means for revolving said trough means and said blade holding means towards each other so as to impart a slicing cut.

2. The meat cutter for slicing soft-meat logs of claim 1 wherein said trough means comprises an L-shaped cross section and at least one slot positioned so as to receive a knife blade.

3. The meat cutter for slicing soft-meat logs of claim 1 wherein said revolving means comprises:

a shaft to which said trough means is attached and about which it revolves;

a first actuating arm having a shaft end and a cam end, said first arm shaft end being attached to said shaft;

a cam follower rotatably mounted to said cam end;

a cam slot located in said blade holding means, said cam follower being located in said cam slot; and means for rotating said shaft.

4. The meat cutter for slicing soft-meat logs of claim 3 wherein said rotating means comprises:

a second actuating arm attached to said shaft; and a hydraulic cylinder attached to said second arm.

5. The meat cutter for slicing soft-meat logs of claim 4 further comprising means for holding said log in said trough means.

6. The meat cutter for slicing soft-meat logs of claim 5 further comprising means for operating said cylinder, said operating means requiring two hands to operate.

7. The meat cutter for slicing soft-meat logs of claim 6 wherein said operating means requires said log-holding means to be in place for operation.

* * * * *